US008511028B2

(12) United States Patent
Lehane, Jr.

(10) Patent No.: US 8,511,028 B2
(45) Date of Patent: Aug. 20, 2013

(54) CLIP CONNECTION

(75) Inventor: James J. Lehane, Jr., McHenry, IL (US)

(73) Assignee: USG Interiors, LLC, Chicago, IL (US)

( * ) Notice: Subject to any disclaimer, the term of this patent is extended or adjusted under 35 U.S.C. 154(b) by 219 days.

(21) Appl. No.: 12/644,037

(22) Filed: Dec. 22, 2009

(65) Prior Publication Data

US 2011/0146184 A1 Jun. 23, 2011

(51) Int. Cl.
*F27D 1/00* (2006.01)

(52) U.S. Cl.
USPC ..... 52/506.07; 52/506.08

(58) Field of Classification Search
USPC ..... 52/664, 665, 667, 668, 666, 506.06, 52/506.07, 506.08, 506.09, 506.1
See application file for complete search history.

(56) References Cited

U.S. PATENT DOCUMENTS 3,320,713 A * 5/1967 Downing, Jr. ..... 52/666
4,108,563 A 8/1978 Brown et al.
4,535,580 A * 8/1985 Shirey ..... 52/506.06
5,044,138 A 9/1991 Zaccardelli et al.
6,018,923 A * 2/2000 Wendt ..... 52/712
6,446,407 B1 * 9/2002 Lehane et al. ..... 52/506.07
7,669,374 B2 * 3/2010 Miller et al. ..... 52/506.07

OTHER PUBLICATIONS

Written Opinion and International Search Report dated Mar. 23, 2011 for corresponding PCT/US2010/061231, filed Dec. 20, 2010.
Design U.S. Appl. No. 29/299,675, filed Jan. 1, 2008, James J. Lehane, "Perimeter Clip Useful for Ceiling Grid Systems".

* cited by examiner

*Primary Examiner* — Jessica Laux
(74) *Attorney, Agent, or Firm* — Pearne & Gordon LLP

(57) ABSTRACT

Producing grid tees with a range of service duty, reflected in the use of various gauge sheet stock, that exhibit an effective uniform thickness at their cross tee slots by locally altering a grid tee in the area of its cross tee receiving slot or slots so that the grid tee has a uniform effective thickness at these area(s) that can be standardized across a manufacturer's range of tee load ratings. Preferably, a grid tee is permanently stamped with an indentation or dimple adjacent the cross tee slot and a cross tee connector has a lead edge area arranged to seat against the bottom of the indentation.

11 Claims, 3 Drawing Sheets

CLIP CONNECTION

BACKGROUND OF THE INVENTION

The invention relates to suspended ceilings and, in particular, to improvements in tee components used to construct a metal grid for such ceilings.

PRIOR ART

Suspended ceilings usually comprise a rectangular grid formed by spaced parallel main runners or tees and cross runners or tees extending perpendicularly between the main runners. The cross tees typically have end connectors that mate with identical connectors of other cross tees being joined end-to-end. The cross tee joints are made in a slot provided in the main tees. Where small grid modules are used in a ceiling construction, the cross tees can also be slotted to receive end connectors of other cross tees. Grid tees are typically made of roll-formed metal sheet stock and the gauge of the sheet stock is varied so that a tee is of adequate strength for the service it is expected to fulfill but, for costs reasons, not excessive. Also for reasons of economy, a manufacturer typically only uses one end connector configuration for all of its cross tee constructions regardless of the gauge or thickness of the stock used to make a slotted tee.

A problem can exist where the same cross tee connector is used for all of a manufacturer's slotted tees. A lighter gauge slotted tee will have a tendency to be loose in the fit provided for it by a cross tee connector. This looseness adversely affects the feel of the joint to the installer and can potentially affect the appearance of the grid as well as the manner in which other components of the ceiling are received and/or are supported by the grid.

SUMMARY OF THE INVENTION

The invention improves the fit of standardized cross tee connectors when received in slots of tees with different gauge thickness for various duty ratings and/or spans. The invention involves the concept of producing grid tees with a range of service duty, reflected in the use of various gauge sheet stock, that exhibit an effective uniform thickness at their cross tee slots. More specifically, the invention comprehends locally altering a grid tee in the area of its cross tee receiving slot or slots so that the grid tee has a uniform effective thickness at these area(s) that can be standardized across a manufacturer's range of tee load ratings.

In a preferred embodiment, a grid tee is permanently stamped with an indentation or dimple adjacent the cross tee slot and the connector has a lead edge area arranged to seat against the bottom of the indentation. The bottom of the indentation of tees made of different gauge thickness are formed with the same spacing from the center plane of the tee. Since the connector registers against it, this indentation bottom surface serves to establish the effective thickness of the slotted tee and in accordance with the invention a tee has the same dimension regardless of the actual gauge of material forming the tee. Ideally, the indentation is laterally offset, with reference to a view of the side of the tee, from the center of the slot so that the material displaced from the indentation for one connector does not substantially affect a similarly offset indentation for an opposing connector on the opposite side of the tee.

DESCRIPTION OF THE PREFERRED EMBODIMENT

Figure 1:
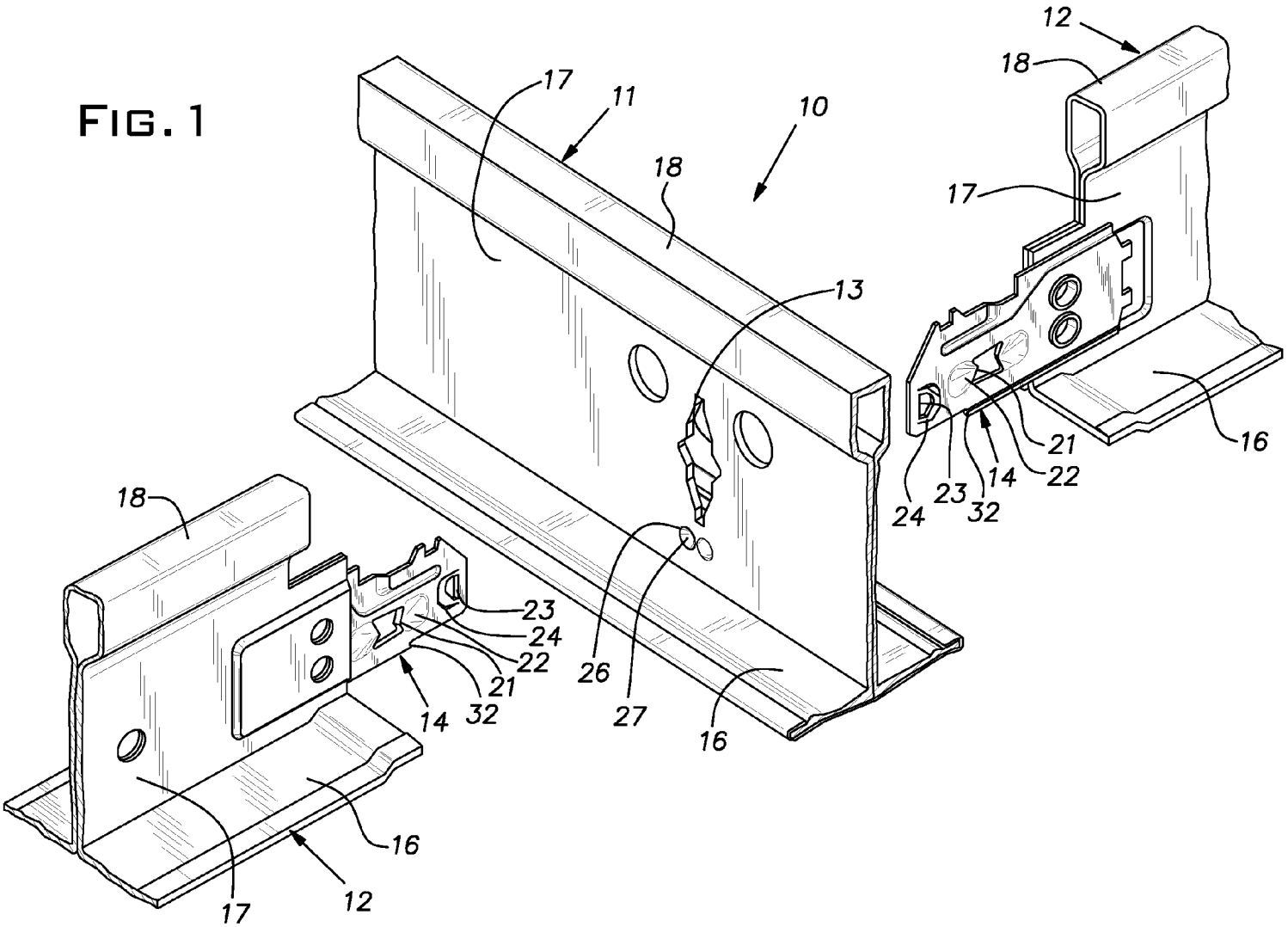
FIG. 1 is an exploded fragmentary perspective view of a slotted tee and a pair of cross tees with end connectors to be joined in the slot of the tee.
Figure 2:
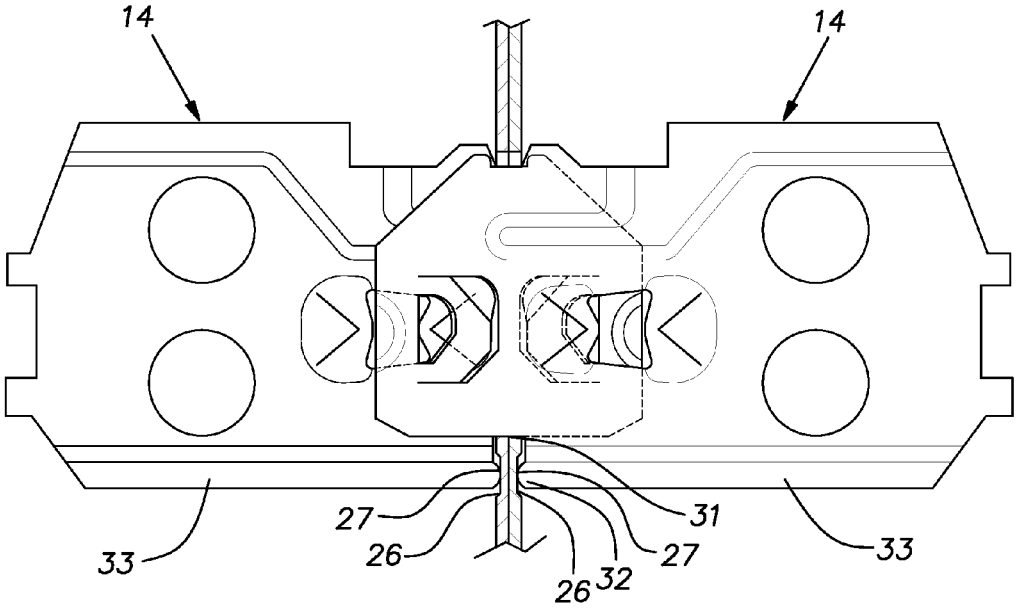
FIG. 2 is an elevational view of the end connectors connected in the slot of the slotted tee of FIG. 1.

Referring now to the figures, there is shown a small section of a suspended ceiling grid 10 at an intersection of tees 11, 12 (exploded in FIG. 1 for clarity). A slotted tee or runner 11 represents a main tee, which typically is 10 or 12' in length (or metric equivalent) or a shorter cross tee. A main tee will have numerous regularly spaced identical slots 13 while a cross tee will have relatively few slots 13 or no slots at all. In various views herein, two opposed cross tees 12 intersect the slotted tee 11 at the slot 13. The cross tees 12 are assembled with end connectors 14 that, in a known manner, lock together when they are both properly inserted in a slot 13. U.S. Pat. Nos. 5,517,796 and 5,761,868, incorporated herein by reference, disclose the general features of the end connector or clip 14. While not shown, but known in the industry, the cross tees 12 can have slots and be intersected by still other cross tees in the grid of the ceiling.

The tees 11, 12 are typically made of roll-formed sheet metal, usually steel that can be a hot-dipped galvanized product, and less frequently aluminum. The tees 11, 12 are symmetrical about a central or medial vertical plane and include, usually, a lower flange 16, a vertical web 17, and an upper hollow reinforcing bulb 18. Normally when a tee is roll-formed of sheet stock, the web is a double layer of a sheet.

Depending on the duty or load rating of a tee 11, 12 and, if it is a cross tee 12, its span, the gauge of the metal sheet varies. By way of example, the thickness of a web 17, i.e. the sum of the thickness of two layers if it is a double layer, can range between 0.050" to 0.019" (or metric equivalent).

The end connectors 14 form a connector-to-connector lock when they are inserted into the same slot 13 from opposite sides of the tee 11. The lock is actually a double lock with a lock being established on each side of a slotted tee 11 by a rearward facing edge 21 of a projection 22 and a rearward facing edge 23 of an opening 24 of the mating connector. Interlocking between the connectors 14 is precisely dimensionally controlled so that dimensional variations are not multiplied in an expansive ceiling grid.

It is desirable that the slotted tee 11 be constrained by the cross tees 12 through the connectors 14 so that the slotted tee 11 is prevented from shifting laterally and/or twisting longitudinally, i.e. about an axis parallel to its longitudinal axis. To be commercially competitive, tees are manufactured with different strengths to meet industry or government standards while not unduly exceeding these standards with unnecessary material content. To satisfy this economic constraint, a manufacturer, inter alia, uses different gauge (thickness) material to construct the tee, the gauge being heavier the greater the duty rating or load capacity of the ceiling grid. Another constraint on a manufacturer is the need to use the same end connector configuration for any cross tee 12 regardless of the duty rating of the grid.

The requisite variation in the web thickness of conventional tees and the need for a single end connector or clip configuration has been problematic. If the connector is proportioned to fit thick webs, slotted grid tees with thin webs are loosely held by the connectors. If a connector would be proportioned to fit closely with a conventional slotted tee with a thin wall web, it would not lock with a mating identical connector on a heavy wall slotted tee because the thicker web would hold the connectors apart.

Figure 5:
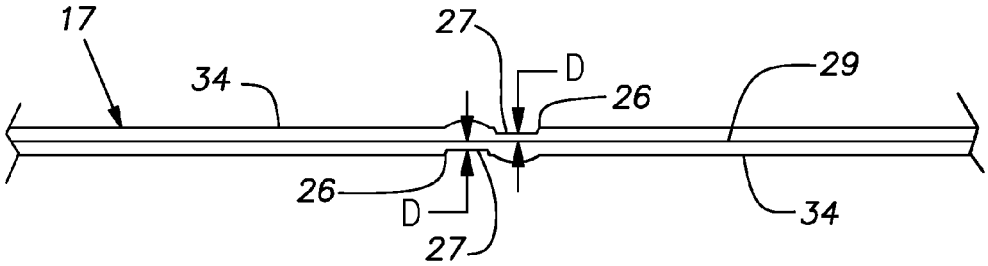
FIG. 5 is a cross sectional view of the slotted tee taken in the horizontal plane view indicated at 5-5 in FIG. 4.

The invention solves the problem of a loose fitting slotted tee by locally modifying the grid tees in the web area of the slot so that regardless of the gauge thickness of the material of their web, they present the same or nearly the same effective thickness to the connectors. Preferably, according to the invention, this is done by permanently displacing material adjacent a slot so that the plane of a surface of the displaced area abutted by a connector has the same or nearly the same spacing from the center of the web as corresponding areas adjacent the slots of grid tees with webs of other thickness. More specifically, web material is permanently displaced by a stamping operation to form an indentation 26. A surface 27 of a base of the indentation 26 has a predetermined distance D (FIG. 5) from a center plane 29 of the web 17. The indentation 26 is asymmetrical or offset to the left from a center line through the slot 13. A lead edge 31 of a connector provided by a projection 32 on a laterally offset flange 33 is aligned with the indentation 26 and abuts the indentation bottom or base surface 27 to index the position of the connector 14 when it is fully installed. The indentation 26 is of sufficient area to receive the cross section of the projection 32 so that the projection is the exclusive element that determines the relative position of a cross tee to the slotted tee. As shown most clearly in FIG. 5, an indentation 26 is formed at each side or face 34 of the web 17. The indentations 26, ideally, are offset from the center line of the slot 13 a sufficient distance such that they do not overlap. Dimensional tolerances of and forces on tooling used to produce the indentation surfaces 27 are less critical than would be the case where the indentations of both sides 34 of the web 14 overlapped one another.

Figure 3:
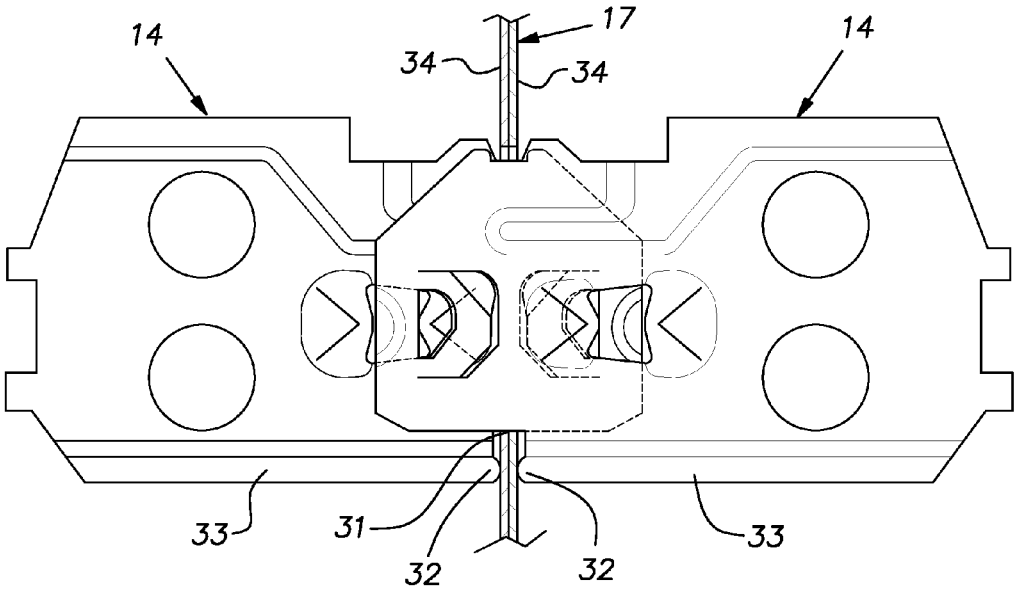
FIG. 3 is an elevational view of the end connectors connected in a slot of a conventional tee.
Figure 4:
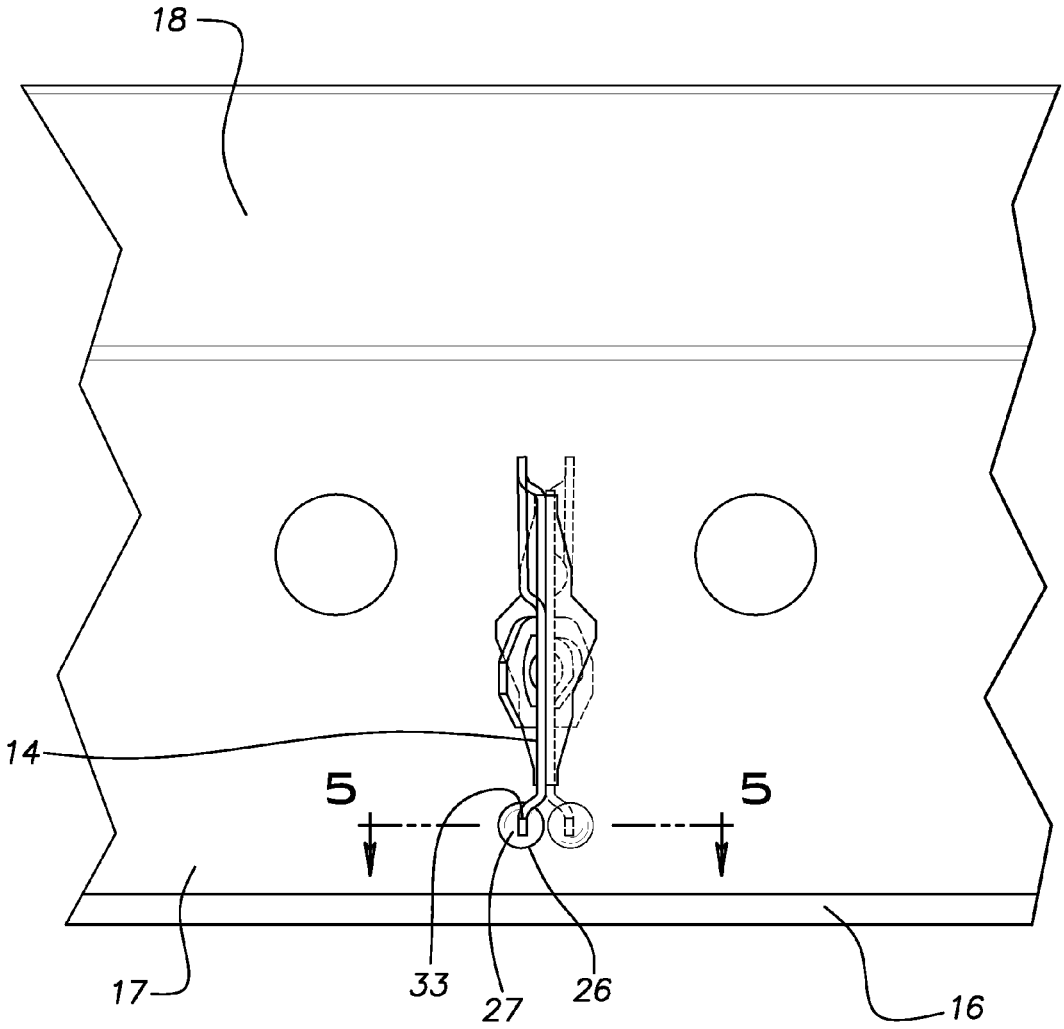
FIG. 4 is a fragmentary elevational view of the end connectors of a pair of cross tees joined in the slot of the tee of FIG. 1.

The predetermined distance D of the indented surface 27 from the center plane 29 can be set at the same nominal dimension as is the outer surface of the thinnest web in a manufacturer's product line so that these lighter duty tees need not be stamped with an indentation. This is the condition illustrated in FIG. 3. Alternatively, a manufacturer may choose to set the nominal dimension at one corresponding to a medium duty web and, therefore, allow a lighter duty web to have a slight but acceptable clearance between a pair of joined connectors.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited. For example, the tees can be configured with the indentation at the same location centered on the slot center line on both sides of a web. Still further, for example, the tees with lighter gauge (thinner webs) can be plastically deformed in the area of a cross tee slot to have the effective thickness of a heavier duty thicker web and the connectors can be configured to engage such area. The invention is applicable to tees with a single layer web and to tees having different flange configurations or bulb configurations than that illustrated.

What is claimed is:

1. A sheet metal grid runner in combination with cross runners having end connectors, the grid runner having a vertical web with at least one cross runner slot receiving the end of a cross runner connector passing through the web and joining directly with an opposed cross runner end connector assembled in said slot, the web, having a thickness throughout a major area of the web substantially equal to the thickness of the sheet metal forming the web, being permanently deformed in a local area adjacent the cross runner slot to change the effective thickness of the web in said local adjacent area from its actual thickness in the major area of the web where the local area is engaged by the cross runner end connector that determines the fit of the runner web between the opposed joined cross runner connectors joined in the slot.

2. The combination as set forth in claim 1, wherein the local area at each face of the web is asymmetrically located with respect to the slot such that the local area of each face does not substantially overlap the local area of the opposite face.

3. The combination as set forth in claim 1, wherein the local area is an indentation on each face of the web.

4. The combination as set forth in claim 3, wherein the local area at each face of the web is asymmetrically located with respect to the slot such that these areas do not substantially overlap one another.

5. The combination as set forth in claim 1, wherein said runner is roll-formed sheet metal.

6. The combination as set forth in claim 5, wherein the sheet metal is hot dipped galvanized steel.

7. The combination as set forth in claim 5, wherein the grid runner is in the form of an inverted tee with a reinforcing bulb at the top and a horizontally oriented flange at the bottom.

8. A suspended ceiling grid system including sheet metal slotted grid runners and intersecting cross runners, the slotted grid runners having a central web and at least one slot, the cross runners having identical end connectors adapted to interlock with each other when assembled in the grid runner slot from opposed sides of the web, the web being locally deformed in an area adjacent the slot to make its effective thickness different from a thickness of a major area thereof substantially equal to the thickness of the metal sheet material forming the web, the end connectors being arranged when interlocked together to closely fit against the locally deformed area.

9. A method of obtaining a predetermined fit between slotted grid runners and cross runner end connectors joined directly together when inserted in a common slot where the grid runners have different thicknesses to satisfy different load ratings comprising the steps of locally permanently deforming the slotted grid runner of at least one group of runners having a nominal web thickness of one dimension in an area adjacent its cross runner receiving slot such that outward facing surfaces of the locally deformed areas are spaced from a central plane of their runners at dimensions substantially equal to the spacing of major outer web surfaces including areas adjacent grid runner slots of another group of runners.

10. A method as set forth in claim 9, wherein the permanently deformed outward facing surface areas are stamped inwardly from their original surface plane.

11. A method as set forth in claim 10, wherein the stamped surface area on one face of a runner is offset laterally with respect to the adjacent cross runner slot and the stamped surface on an opposite face of the runner is similarly offset with respect to the cross runner slot with reference to its original surface whereby the stamped surface areas at a common slot are substantially free of mutual overlap.

* * * * *